United States Patent [19]

Ecomard et al.

[11] 4,423,715

[45] Jan. 3, 1984

[54] FUEL PUMP-INJECTOR UNITARY ASSEMBLY FOR INTERNAL COMBUSTION ENGINE

[75] Inventors: André Ecomard, Marly-le-Roi; Louis Briand, Sevres; Philippe Pinchon, Rueil-Malmaison, all of France

[73] Assignee: Institut Francais du Petrole, Rueil-Malmaison, France

[21] Appl. No.: 277,588

[22] Filed: Jun. 26, 1981

[30] Foreign Application Priority Data

Jun. 27, 1980 [FR] France ..... 80 14370

[51] Int. Cl.[3] ..... F02M 59/20

[52] U.S. Cl. ..... 123/501; 239/88

[58] Field of Search ..... 123/501, 503; 239/88, 239/90, 125, 89, 91, 92, 93

[56] References Cited

U.S. PATENT DOCUMENTS

| | | | |
|---|---|---|---|
| 1,847,718 | 3/1932 | Herr | 123/501 |
| 2,147,390 | 2/1939 | Vaudet | 123/503 |
| 2,173,812 | 9/1939 | Bischof | 123/503 |
| 2,317,618 | 4/1943 | King | 239/88 |
| 2,635,590 | 4/1953 | Simon | 239/93 |
| 2,986,134 | 5/1961 | Bernard | 123/501 |
| 3,368,491 | 2/1968 | Shook et al. | 239/88 |
| 3,667,437 | 6/1972 | Dreisin | 123/501 |
| 4,146,178 | 3/1979 | Bailey | 239/90 |
| 4,327,694 | 5/1982 | Henson et al. | 123/503 |

*Primary Examiner*—Ira S. Lazarus
*Assistant Examiner*—Magdalgn Moy
*Attorney, Agent, or Firm*—Millen & White

[57] ABSTRACT

A pump-injector assembly comprises a plunger slidable in a bore. The plunger has a first or upper position in which fuel is admitted into the lower part of the injector bore through an inlet port, and a second or lower position in which a tapered lower end of the plunger obturates fuel spray nozzles provided through the bottom of the bore. A recess is provided in the plunger wall and communicates with the bottom of the bore through a longitudinal passageway of the plunger. A ramp inclined to the plunger axis is formed by the upper edge of the recess and co-operates with a fuel outlet port located on the wall of the injector bore to control the beginning of the injection. Rotation of the plunger relative to this outlet port permits adjustment of the amount of injected fuel charge.

10 Claims, 11 Drawing Figures

FUEL PUMP-INJECTOR UNITARY ASSEMBLY FOR INTERNAL COMBUSTION ENGINE

BACKGROUND OF THE INVENTION

The present invention relates to a pump injector unitary assembly both for fuel metering and fuel injection in an internal combustion engine.

In U.S. Pat. No. 3,131,866 and the report "Simulation of the Commins Diesel Injection System" of Andrew Rosseli and Pat Badgley to the Society of Automotive Engineers No. 710570, there is disclosed a fuel injector comprising an injector body provided with an axial bore whose bottom is traversed by at least one fuel spray nozzle.

An inlet duct for pressurized fuel opens in this bore near its bottom, and this duct is connected with a fuel inlet circuit.

A plunger, or needle, is slidable in this bore between a first or upper position where this plunger is spaced from the bore bottom, and a second or lower position corresponding to the end of the injection, where the tip or tapered end of this plunger obturates the fuel spray nozzles by contact with the bottom of the bore.

The displacements of the plunger are controlled by the assembly of a cam, a push rod and a rocker-arm, against the action of a return spring.

With such an injector, the fuel charge injected during each piston stroke is adjusted by metering the fuel quantity admitted into the bore through the inlet duct.

The bore is filled with a greater or lesser fuel quantity, depending on the fuel charge to be injected, at the moment where the plunger begins its downward stroke for injecting fuel.

To this end, fuel is supplied to the inlet port of the pump-injector assembly under a pressure varying in relation to the position of the gas pedal and the engine running speed. Thus, the fuel quantity admitted into the bore varies with the inlet pressure and the duration of the fuel metering period (this period being inversely proportional to the engine running speed), hence the designation of P-T. (i.e. Pressure-Time) system.

The drawbacks of such systems are to be found, on the one hand, in the difficulty of balancing the fuel flow rates delivered by the different injectors in a multicylinder engine due to the importance of an accurate calibration of the fuel inlet port in each injector, and, on the other hand, in the method itself of automatically controlling the injection through the fuel supply pressure.

Other injection systems are described in German Patent Application No. 2,719,228, in French Pat. No. 1,108,081 and in U.S. Pat. No. 2,635,590, these systems comprise a pump-type device for transferring the metered fuel quantity into that portion of the injector where the injection nozzles open. In such prior art devices gases are admitted into the injection system and not only the beginning of the injection varies with the fuel charge due to the high compressibility of these gases, but furthermore, the beginning of the injection cannot be known with accuracy.

SUMMARY OF THE INVENTION

The problem of the fuel charge metering is solved according to the invention by providing a pump-injector unitary assembly having an axial bore whose bottom is traversed by at least one fuel spray nozzle, at least one fuel inlet duct opening into said bore in the vicinity of its bottom, at least one fuel outlet or discharge duct opening on the wall of the bore at a level different from that of the inlet duct, a plunger or needle slidable in said bore between a first position where the plunger is spaced from the bore bottom, and a second position where the tip or tapered end of the plunger obturates the spray nozzles. The pump injector assembly is further provided with metering means comprising:

(a) a recess in the plunger wall communicating with said outlet or discharge duct when the plunger is in its first position, at least a portion of the upper edge of this recess forming a ramp inclined to the plunger axis, said ramp controlling the beginning of the injection by obturation of the port of said outlet duct, when the plunger is moved towards its second position, (b) a transfer passage-way having one end in communication with said recess and its other end opening near the bottom of said bore, said other end of the transfer passage-way being obturated when the plunger is in its second position, and (c) means for adjusting the relative angular position of the plunger and of the outlet duct.

The transfer passage-way may be provided in the body of the device or in the plunger or needle.

According to a preferred embodiment, the pump-injector assembly, which comprises a push-rod cooperating with means for displacing the plunger, is characterized in that this push-rod is slidably mounted in a cylindrical recess of the plunger, communicating with the fuel outlet duct.

BRIEF DESCRIPTION OF THE DRAWINGS

One embodiment of the invention is illustrated by the accompanying drawings wherein.

DETAILED DESCRIPTION OF THE INVENTION

Figure 1:
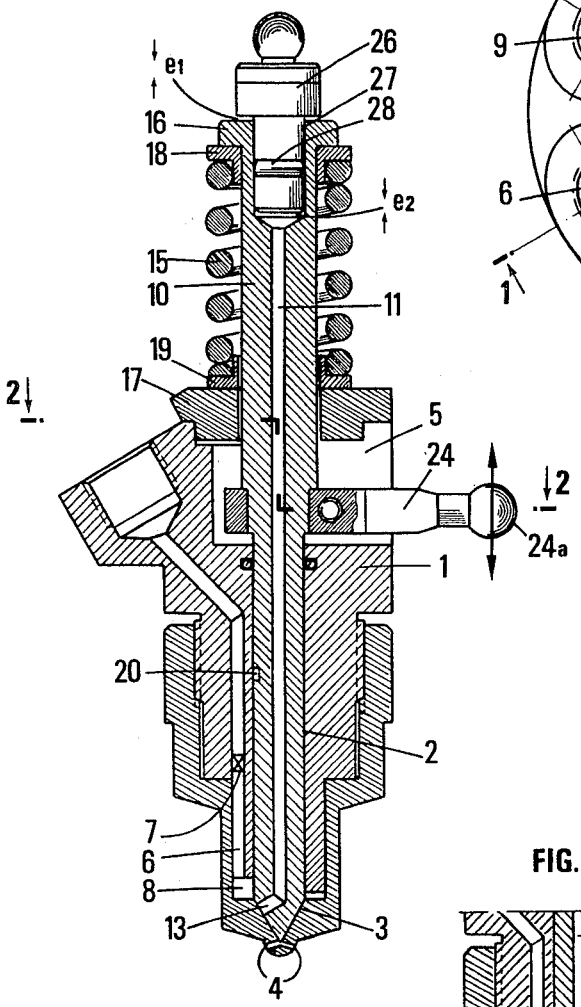
FIG. 1 is a longitudinal cross-sectional view of the pump-injector assembly.

FIG. 1 illustrates a first embodiment of the pump-injector unitary assembly according to the invention. This assembly comprises an injector body 1 having an axial bore 2 whose bottom or lower end 3 is traversed by at least one spray orifice or nozzle through which fuel is injected, the upper end of this bore opening in a recess 5 of the injector body.

A fuel supply duct 6, provided with a non-return valve 7 and connected to a circuit supplying fuel under pressure (not shown), permits fuel admission into this bore 2 where the conduit 6 opens at 8 near the bottom 3 of this bore. A fuel discharge or outlet duct 9, which is connected to a fuel outlet or return circuit (not shown) through which fuel flows back to the fuel tank, opens at **9*a* in the bore 2 at some distance from the bottom 3** of this bore.

A plunger or needle 10 is slidable in the bore 2 between a first or upper position where this plunger is spaced from the bottom 3 of the bore and a second or lower position, illustrated in FIG. 1, where this plunger is applied against the bore bottom and obturates the injection nozzles 4.

Figure 2:
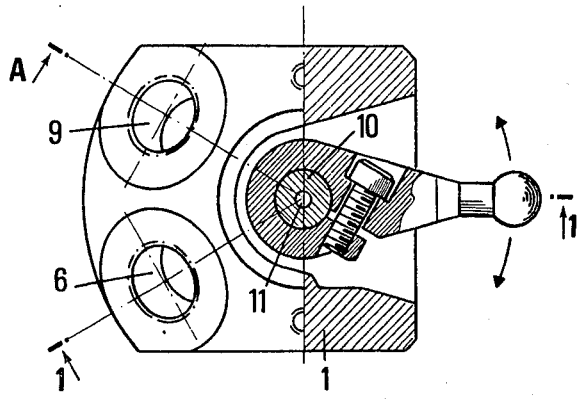
FIG. 2 is a top view showing the fuel supply or inlet ports and the fuel return, or outlet ports.
Figure 2A:
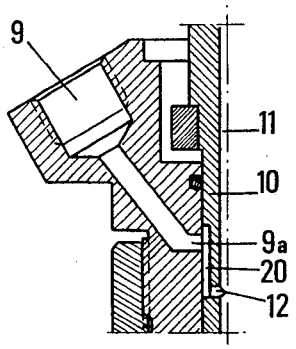
FIG. 2A is a cross-section along line A—A of FIG. 2.

The plunger 10 is provided with a recess 20 (FIG. 2A) which communicates with the discharge or outlet duct 9 in the first position of the plunger 10.

Figure 3:
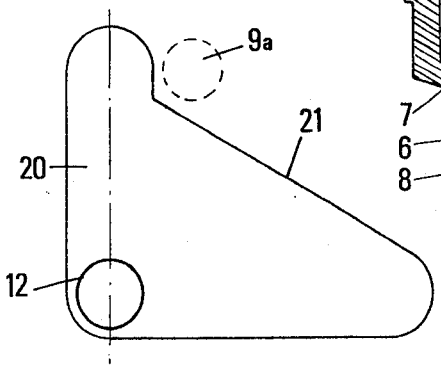
FIG. 3 is a developed view of the plunger wall at the level of the ramp which controls the injection, FIG. 4 diagrammatically shows the device for adjusting the angular position of the plunger relative to the outlet port, FIGS. 5 to 8 diagrammatically illustrate the operation of the pump-injector assembly according to the invention.

At least a portion of the upper part of the recess 20 forms a ramp 21 inclined to the axis of the plunger 10 (FIG. 3), this ramp controlling the beginning of the injection as indicated below.

The plunger 10 is provided with a transfer passage-way having a first end 12 in communication with the recess 20 and a second end 13 which opens at the free end of the plunger 10, so that this second end 13 is obturated in the second or lower position of the plunger, which corresponds to the injection end (FIG. 1). In this embodiment the end 13 of the transfer passage-way is obturated by the bore bottom.

This pump-injector device is so designed as to permit injection of a determined fuel charge. This injection is effected by downwardly displacing the piston, such displacement resulting from the action of a cam driven in rotation by the engine, and against the action of a return spring 15.

This spring is positioned between an annular shoulder 16 of the plunger 10 and a bearing ring 17 fitting in the injector body 1 at the upper part of the recess 5.

Plates 18 and 19 are placed between the spring 15, the shoulder 16 and the bearing ring 17 respectively.

Means for adjusting the angular position of the plunger 10 provided with the ramp 21, with respect to the port 9*a* of the discharge or outlet duct 9 opening in the bore 2, makes it possible to adjust the fuel charge injected during each up-and-down stroke of the plunger.

Figure 4:
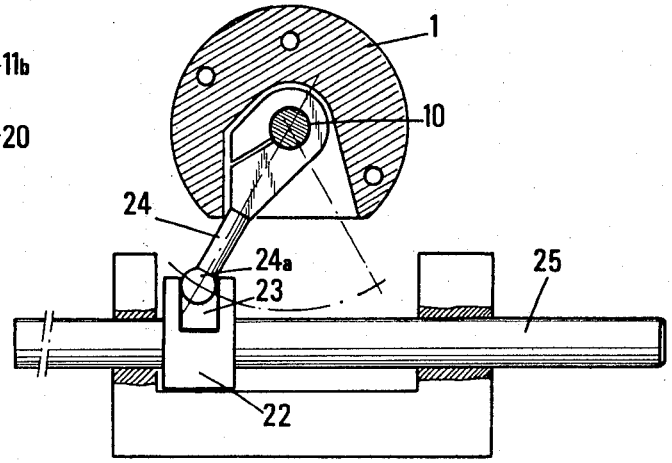

These means, which may comprises a rod system or linkage actuated by the gas pedal of the engine, may include, as in the embodiment illustrated in FIG. 4, a control element 22 comprising a recess 23 housing a ball-head 24*a* located at the end of a control rod 24, fast in rotation with the plunger 10, the recess 23 being of elongate shape in a direction parallel to the axis of this plunger so as to permit axial displacements thereof.

Figure 5:
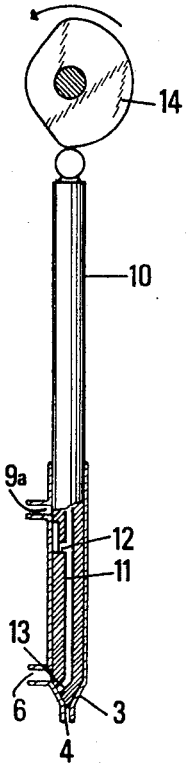
Figure 6:
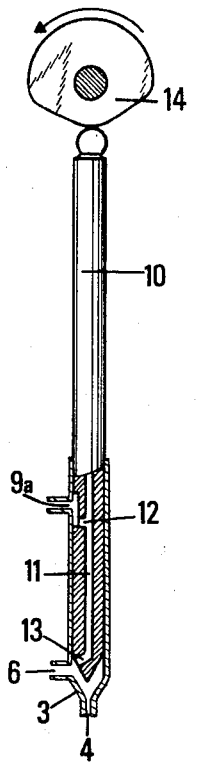
Figure 7:
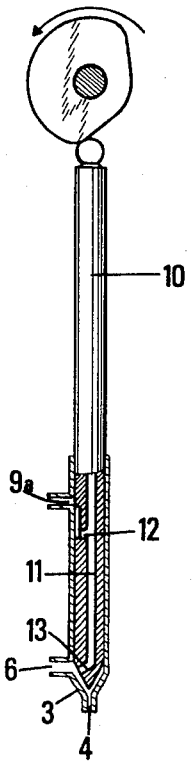

The operation of this pump-injector assembly is diagrammatically illustrated in FIGS. 5 to 7.

Upward displacement of the plunger from the position illustrated in FIG. 5, first causes a fuel suction effect, as long as the recess 20 being obturated by the wall of the plunger 10 is not in communication with the discharge duct 9, then fuel further fills the whole space between the bottom 3 of the bore 2 and the free end of the plunger, under the effect of the fuel feeding pressure prevailing in the duct 6, up to the top dead center of the plunger 10 (position illustrated in FIG. 6).

In this position of the plunger, the port 9*a* is located above the ramp 21 and the lower part of the bore 2 is filled with fuel which can flow from the duct 6, provided with the non-return valve 7, to the fuel tank (not shown), through the passage-way 11 of the plunger and the return duct 9 connected with the fuel tank.

In the position of the plunger illustrated in FIG. 7, the ramp 21 has passed over the port 9*a* during its downward stroke and this port is obturated by the inner wall of the plunger 10.

Consequently fuel can no longer flow towards the return duct 9.

As the plunger is further displaced towards the bottom 3 of the bore 2, fuel is expelled under pressure through the spray nozzles 4.

Figure 8:
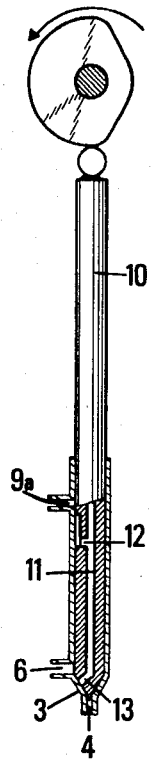

Injection ends when these nozzles are obturated by the tip or tapered end of the plunger, in the position illustrated in FIG. 8.

When the cam 14 has come back to its initial position (FIG. 5), the plunger 10 is again lifted by the spring 15 and the above described cycle starts again.

As a result of the inclination of the ramp 21 on the axis of the plunger 10, the duration of the obturation of the port 9*a* by the outer wall of the plunger 10 can be varied, i.e. the fuel charge injected during each cycle can be metered by rotation of the plunger 10 about its axis, by means of the control device 24.

As compared to the Cummins injection system described in the introductory part, where fuel metering is obtained by varying the fuel supply pressure, the pump injector system according to the invention is a system where fuel metering is achieved by mechanical means, irrespective of the value of the fuel supply pressure, thus providing many advantages, among which:

- balancing of the fuel flow rates through the different injectors in a multi-cylinder engine, this balancing being improved over the whole operating range of the engine (running speed-fuel charge);
- regulation of the fuel flow rate by actuation of a control device which is of conventional type in injection pumps.

Moreover this control system by rotation of the plunger limits the number of elements making up the assembly and makes use of a well-tested technology (conventional piston of an injection pump), as regards both the machining and the control method itself. (See FIG. 4).

As illustrated in FIG. 1, the pump injector unitary assembly comprises at its upper part a push rod 26 which is slidably mounted in an axial cylindrical recess 27 of the plunger, the bottom of this recess communicating with the longitudinal bore 11 provided in the plunger 10 or with the recess 20.

An annular gasket 28, carried by the push rod 26, provides for fuel sealing.

Such an arrangement obviates the drawbacks which might result from a double mechanical stop or abutment: the first stop being at the contact of the cam with the upper end of the plunger 10 and the second stop at the contact of the tapered end of the plunger with the bottom 3 of the bore 2 in the position of injection end illustrated in FIGS. 1 and 8.

Such a double stop or abutment may actually result in a defective operation of the device, due to the two following difficulties:

- risk of fluid leakage through the nozzles 4 after the injection end, if the tapered end of the plunger 10 is not pressed with a sufficient force against the bore bottom 3,
- risk of deterioration of the tapered end of the plunger and/or of its seat 3, if an excessive force presses the plunger against its seat.

This drawback is obviated with the selected embodiment, where the pressurized fuel is used to compensate for the axial clearances resulting from the machining tolerance and from wear, as well as from differences in thermal dilatation, the pressurized fuel providing for a liquid stop or abutment.

The clearance $e_1$ (FIG. 1) will be of the order of several tenths of millimeter.

The clearance $e_2$ will be at least equal to $e_1$, but not too large, so as to avoid any excessive increase of the dead volume filled with fuel.

Figure 9:
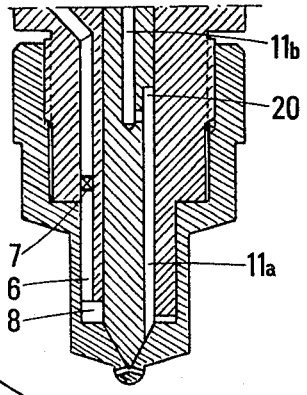
FIGS. 9 and 10 are the two alternative embodiments.

FIG. 9 shows another embodiment in which a groove 11*a* provided in the plunger is substituted for the transfer duct 11.

This groove opens in the recess 20 and extends to the end of the plunger. In this embodiment the groove 11*a* remains in communication with the fuel supply duct when the plunger is in its second position corresponding to the end of the injection. However it would be possible, as in the embodiment of FIG. 1, to isolate the transfer passage-way 11*a* from the fuel supply duct by obturating the end of the transfer passage-way. Such modification being within the ordinary skill in the art has not been illustrated.

A conduit 11*b* provided in the plunger communicates with the groove 11*a* and/or with the recess 20 to compensate for mechanical clearances, as above indicated.

Figure 10:
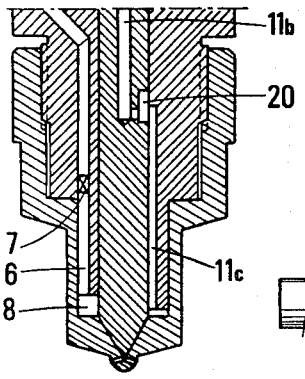

FIG. 10 illustrates another embodiment of the invention where the recess 20 is provided in the wall of the plunger 10, while the transfer passage-way 11*c* is provided in the wall of the bore in the form of a groove which extends to the bottom of the bore and whose upper end is in permanent communication with the recess 20.

Obviously a conduit provided in the body 1 could be substituted for the groove 11*c*.

What is claimed is:

1. A fuel pump and injector unitary assembly for an internal combustion engine having an axial bore with a bore wall and a bottom portion traversed by at least one fuel spray nozzle, at least one inlet duct opening in said bore near said bottom portion, and said inlet duct being in communication with a fuel source, said communication precluding an intermediate metering chamber, at least one fuel outlet port opening on said bore wall at a level different from that of said inlet duct, a plunger having a wall, a tapered end and a central axis, and being slidable in said bore between a first position wherein said plunger is spaced from the bore bottom portion and a second position, corresponding to the injection end, wherein said tapered end of said plunger obturates said spray nozzles at said bottom portion, said fuel pump and injector unitary assembly further comprising metering means for injecting an adjustable fuel charge during the displacement of said plunger towards said second position, said metering means comprising in combination:

(a) a recess, having an upper and lower edge, located in said plunger wall in communication with said outlet duct when said plunger is in said first position, at least a portion of the upper edge of said recess defining a ramp inclined to the plunger axis, and said ramp being for controlling the beginning of the injection by obturating said outlet duct when said plunger moves to said second position, (b) a transfer passageway in said plunger having one end in communication with said recess and its other end opening near the bottom of said bore, and (c) means for adjusting the relative angular position of said plunger and of said outlet duct.

2. A pump-injector unitary assembly according to claim 1, wherein said transfer passageway is a longitudinal duct in the plunger which opens near the tapered end thereof.

3. A pump-injector unitary assembly according to claim 1, wherein said passageway is a groove provided in the plunger wall.

4. A pump-injector unitary assembly according to claim 1, wherein said transfer passageway is a groove provided in the bore wall.

5. A pump-injector unitary assembly according to claim 3 or 4, wherein at least a portion of said groove extends axially with respect to said plunger.

6. A pump-injector unitary assembly according to claim 1, wherein said transfer passageway is a longitudinally extending duct provided in said injector body.

7. A pump-injector unitary assembly according to claim 1, further comprising a push-rod cooperating with means for displacing the plunger, said push-rod being slidably mounted in a cylindrical bore of the plunger in communication with said recess.

8. A pump-injector unitary assembly according to claim 7 further comprising spring means for urging said plunger into said first position, and rotatable cam means adapted for being driven in rotation by an engine operatively associated with said push-rod for causing reciprocating movement of said plunger between said first and second positions.

9. A pump-injector unitary assembly according to claim 1 wherein said inlet duct is adapted for direct connection to a fuel source.

10. A pump-injector unitary assembly according to claim 1, 7, 8, or 9 wherein said outlet means for adjusting the relative angular position of said plunger and of said duct comprises a system activated by the gas pedal of an engine.

* * * * *